US006857910B2

(12) United States Patent
Lin

(10) Patent No.: US 6,857,910 B2
(45) Date of Patent: Feb. 22, 2005

(54) TELECOMMUNICATION SOCKET STRUCTURE

(76) Inventor: Chang-Liang Lin, 4F, No. 538, Sec. 1 Min-Sheng N. Rd., Kuishan Hsiang, Taoyuan County (TW)

( * ) Notice: Subject to any disclaimer, the term of this patent is extended or adjusted under 35 U.S.C. 154(b) by 15 days.

(21) Appl. No.: 10/334,991

(22) Filed: Jan. 2, 2003

(65) Prior Publication Data

US 2004/0132345 A1 Jul. 8, 2004

(51) Int. Cl.[7] ..... H01R 24/00
(52) U.S. Cl. ..... 439/676
(58) Field of Search ..... 439/676, 677

(56) References Cited

U.S. PATENT DOCUMENTS 6,186,835 B1 * 2/2001 Cheshire ..... 439/676
6,273,761 B1 * 8/2001 Hsu et al. ..... 439/676

FOREIGN PATENT DOCUMENTS

| | | |
|---|---|---|
| TW | 79211910 | 10/1990 |
| TW | 81210219 | 7/1992 |
| TW | 81212824 | 9/1992 |
| TW | 82215428 | 10/1993 |
| TW | 83202859 | 3/1994 |
| TW | 83203192 | 3/1994 |
| TW | 83203193 | 3/1994 |
| TW | 85217005 | 6/1996 |
| TW | 86207512 | 5/1997 |
| TW | 87202650 | 2/1998 |
| TW | 88210932 | 7/1999 |
| TW | 89221407 | 7/1999 |
| TW | 89221408 | 7/1999 |

* cited by examiner

*Primary Examiner*—Phuong Dinh
(74) *Attorney, Agent, or Firm*—Trowell Law Office PLLC

(57) ABSTRACT

A telecommunication socket structure including a rigid housing defining an internal cavity and at least one resilient arm disposed in the cavity near an opening thereof. The resilient arm has a free end formed with a first and a second projecting sections which are adjacent to each other. The first and second projection sections are respectively positioned in forward and backward positions in the cavity. The surfaces of the first and second projection sections are respectively inward and outward inclined. In case an incorrect smaller telecommunication plug is inserted into the socket, a straight stopper section of the first projecting section facing outward will stop the plug from entering the socket. When a correct larger telecommunication plug is inserted into the socket, along the outward inclined face of the second projecting section, the plug will gradually press the second projecting section to bias the free end of the resilient arm to outer side of the cavity. Therefore, the plug can be smoothly plugged into the socket.

4 Claims, 5 Drawing Sheets

TELECOMMUNICATION SOCKET STRUCTURE

BACKGROUND OF THE INVENTION

The present invention is related to an improved telecommunication socket structure which prevents an incorrect smaller telecommunication plug from being plugged into the socket. Therefore, the short circuit and damage of relevant equipment caused by negligence can be avoided.

By means of telecommunication plug and socket, one end of a modem can be connected with a computer, while the other end can be connected with a network line for transmitting data. Taiwanese Patent Application Nos. 89221407, 89221408, 87202650, 88210932 disclose improved telecommunication socket structures. Taiwanese Patent Application No. 86207512 discloses a dustproof cover of telecommunication socket. Taiwanese Patent Application No. 83202859 discloses a telecommunication socket free from electric wave interference. Taiwanese Patent Application No. 81212824 discloses a telecommunication socket preventing copper tin from detaching. Taiwanese Patent Application No. 83203193 discloses a jumping device of telecommunication socket. Taiwanese Patent Application No. 82215428 discloses a shielding plate structure for shielding telecommunication socket. Taiwanese Patent Application No. 81210219 discloses a lead filament structure of telecommunication socket. Taiwanese Patent Application No. 7921191 discloses a panel structure of telecommunication socket. Taiwanese Patent Application No. 85217005 discloses an improved connecting structure in telecommunication socket. The socket housing is formed with slide channels having fixed width, stepped recesses and grid partitioning boards. A rib can be fitted into the slide channel and adapted to the stepped recess, whereby a plug can be inserted into and mated with the socket. Taiwanese Patent Application No. 83203192 discloses an improved inner socket of telecommunication socket. The socket includes an inner and an outer socket housings. The inner socket housing has a terminal which can be soldered with the pin of a circuit board. The terminal is mounted on a terminal bed having a base section, top face, grooves, projecting block reverse hook of which projects in reverse direction and tubular passage. In cooperation with a vertically extending section and a horizontally extending section, the leg end can be pressed into the press board of the channel and latched with the latch section of the reverse hook to fasten the guide way and the finger-shaped section.

The above Patents fail to disclose any special assembling structure or idleproof design of the telecommunication socket and plug. For example, the existent modems can be divided into narrow-band system connected by telephone line and wide-band system connected with wide-band network line. Practically, the modems are generally connected by means of telecommunication sockets and plugs having substantially identical pattern and equal size. However, in general, the wide-band telecommunication sockets and plugs have a width is slightly larger than the width of the narrow-band telecommunication sockets and plugs. In actual operation, it often takes place that the smaller narrow-band plug is inserted into the larger wide-band socket. This will lead to short circuit of the modem or relevant device. Typically, a telephone plug is often negligently plugged into the wide-band socket to result in short circuit of the modem.

SUMMARY OF THE INVENTION

It is therefore a primary object of the present invention to provide a telecommunication socket structure including a rigid housing defining an internal cavity and at least one resilient arm disposed in the cavity near an opening thereof. The resilient arm has a free end formed with a first and a second projecting sections which are adjacent to each other. The first and second projecting sections are respectively positioned in a narrower and a wider positions in the cavity. The surfaces of the first and second projecting sections are respectively inward and outward inclined. In case an incorrect smaller telecommunication plug is inserted into the socket, a straight stopper section of the first projecting section facing outward will stop the plug from entering the socket. When a correct larger telecommunication plug is inserted into the socket, along the outward inclined face of the second projecting section, the plug will gradually press the second projecting section to bias the free end of the resilient arm to outer side of the cavity. Therefore, the plug can be smoothly plugged into the socket and connected therewith.

The present invention can be best understood through the following description and accompanying drawings wherein:

DETAILED DESCRIPTION OF THE PREFERRED EMBODIMENT

Figure 1:
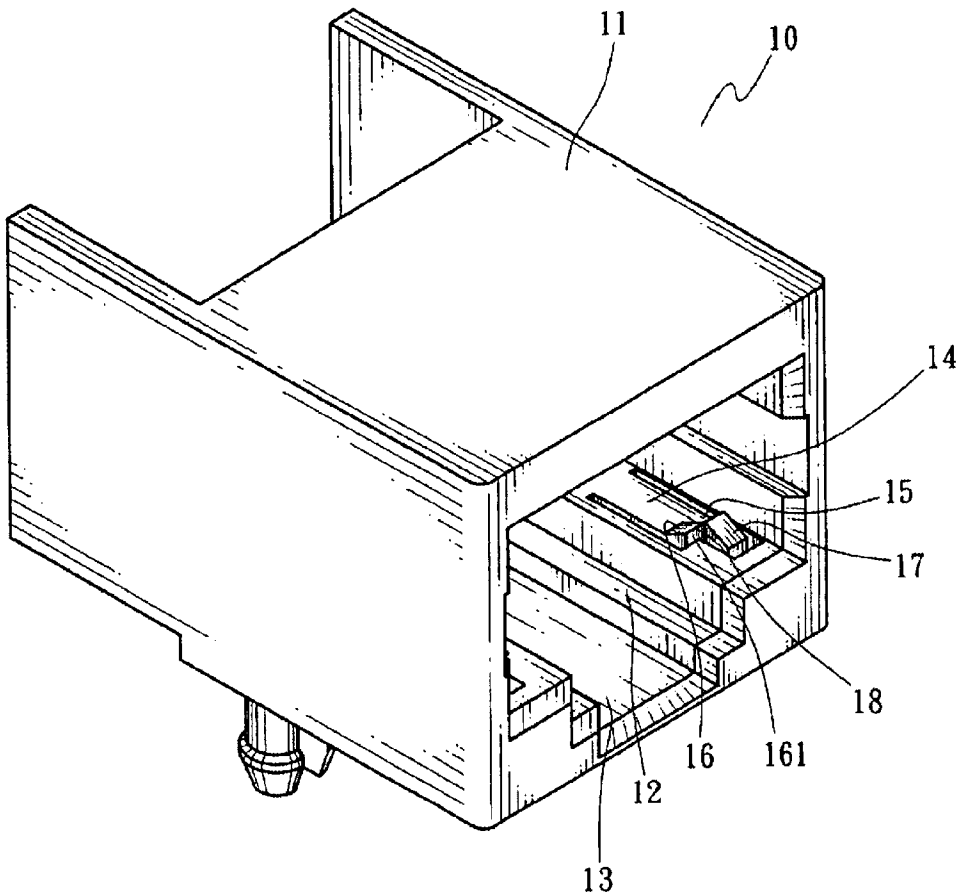
FIG. 1 is a perspective view of a preferred embodiment of the present invention.
Figure 2:
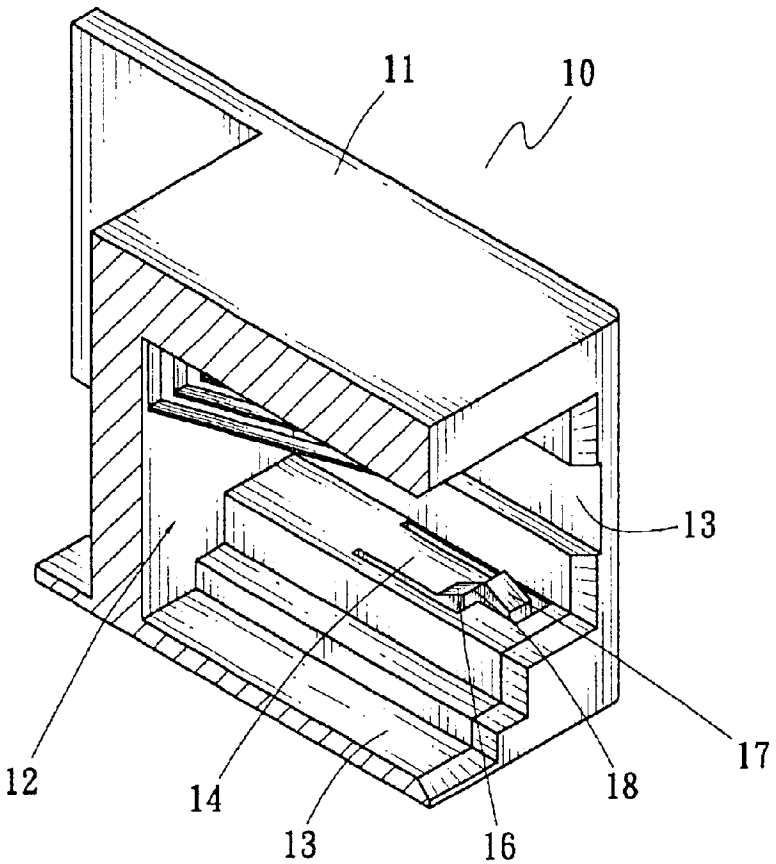
FIG. 2 is a longitudinal sectional view according to FIG. 1.

Please refer to FIGS. 1 and 2. The telecommunication socket structure 10 of the present invention includes a rigid housing 11 defining an internal cavity 12. The inner face of the housing 11 is formed with channels or rails 13 for guiding a telecommunication plug to insert into the socket 10 and restricting the plug from laterally displacing. A pair of resilient arms 14 are symmetrically disposed in the cavity 12 near the opening of the socket 10. In this embodiment, the resilient arms 14 are arranged on inner face of the cavity 12 in symmetrical positions near the opening and extend in insertion direction of the plug 20. The resilient arm 14 has a free end 15 which can be biased by external force.

One face of the free end 15 of the resilient arm 14 facing the cavity 12 is formed with a first projecting section 16 and a second projection section 17 which are adjacent to each other. The first projecting section 16 is positioned in backward position relative to a front of the cavity 12 and inward inclined, while the second projecting section 17 is positioned in a forward position relative to a front of the cavity 12 and outward inclined. At least the first projecting section 16 is formed with a stopper section 161 facing the opening. As shown in FIGS. 1 and 2, the uppermost points of the first and second projecting sections 16. 17 form a connecting or continuous ridgeline 18. Accordingly, the first and second projecting sections 16, 17 have the same height in the cavity 12. The second projecting sections 17 are formed in a wider outer position in the cavity 12 relative to the first projecting sections 16 in insertion direction of the plug. The first projecting section 16 is formed with a stopper face (stopper section) 161 which faces the opening and is perpendicular to the inner face of the cavity 12.

Figure 3:
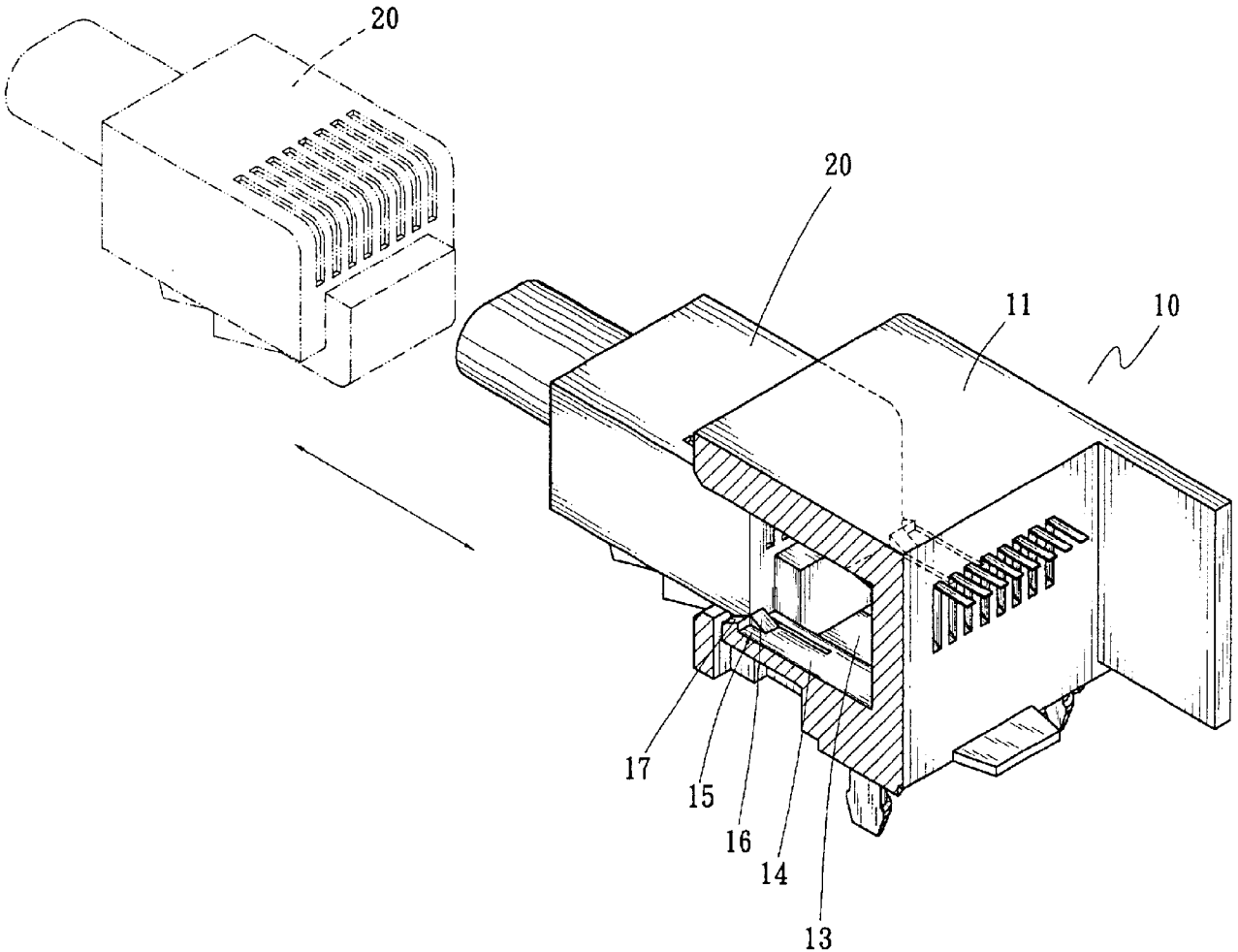
FIG. 3 shows that an incorrect telecommunication plug is plugged into the socket of the present invention.

Referring to FIG. 3, in a typical embodiment, the telecommunication socket 10 is applicable to a wide-band modem system. The width of the cavity 12 is about 3 mm wider than a narrow-band socket. Therefore, in case an operator incorrectly inserts the plug into the socket 10 or inserts a narrow-band telecommunication plug 20 into the socket 10, the plug 20 with insufficient width will be stopped by the stopper section 161 of front end of the first projecting section 16 of the resilient arm 14. Therefore, the plug 20 cannot be plugged into the socket 10. Accordingly, the short circuit and damage of the modem or relevant equipment caused by negligence can be minimized.

Figure 4:
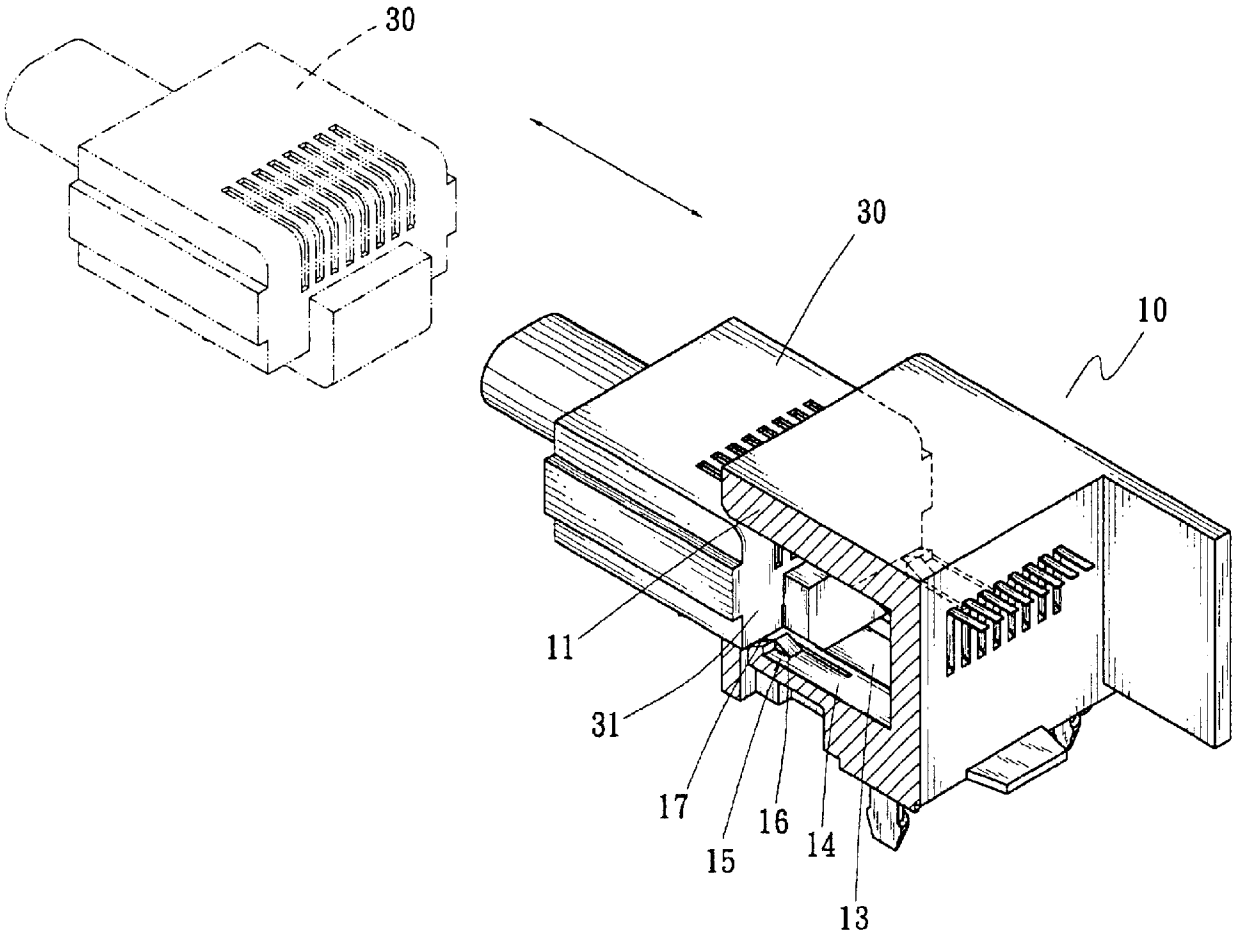
FIG. 4 shows that a correct telecommunication plug is plugged into the socket of the present invention.
Figure 5:
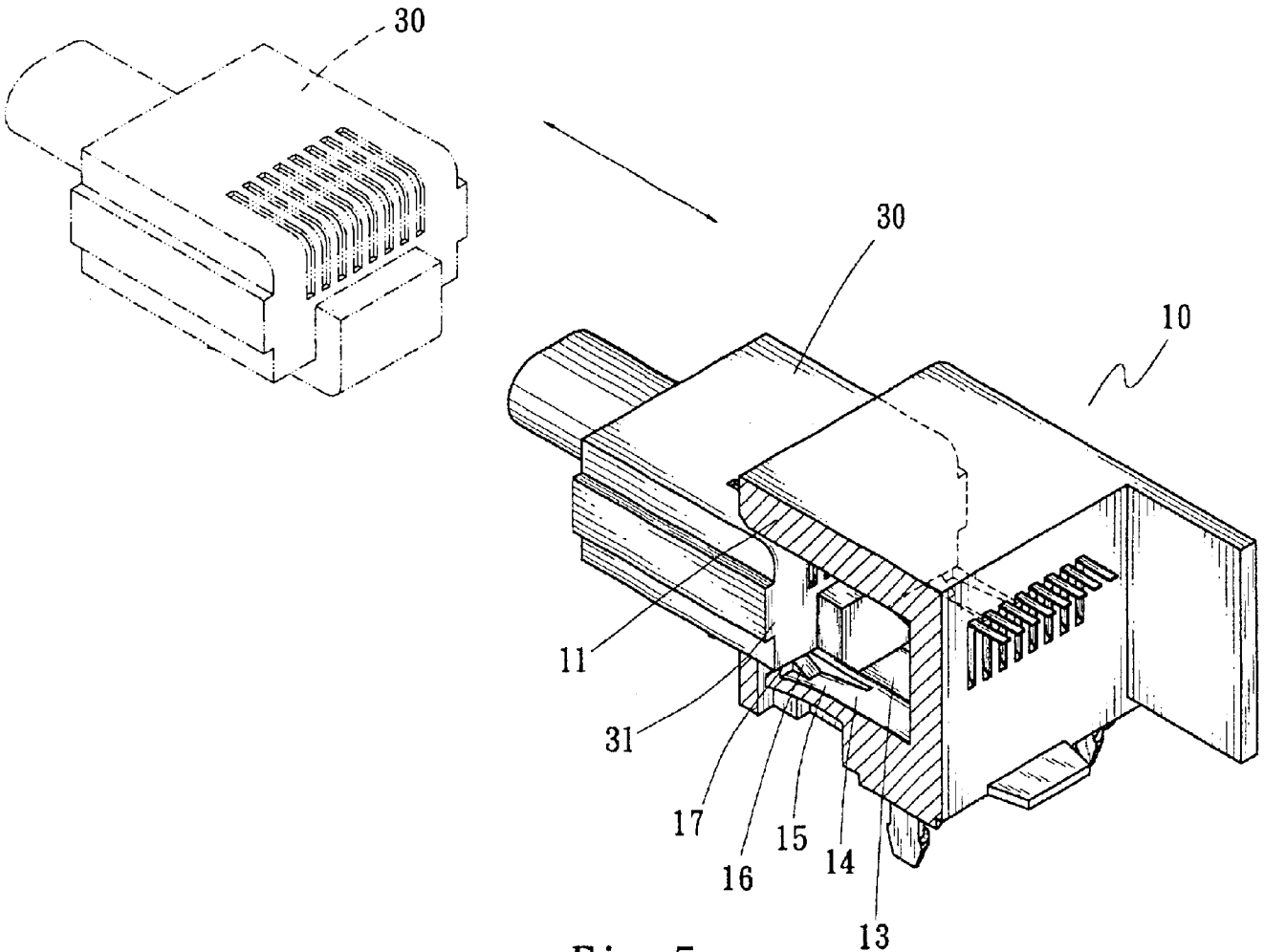
FIG. 5 shows that the plug in FIG. 4 biases the resilient arm of the socket of the present invention.

FIGS. 4 and 5 show that when a correct wider telecommunication plug 30 is inserted into the socket 10, the cavity 12 is totally filled up with the width of the head end 31. Therefore, when inserted, along the inclined face of the second projecting section 17 facing the opening, the bottom face of the plug 30 can gradually press the free end 15 of the resilient arm 14 and bias the free end 15 to outer side of the cavity 12 as shown in FIG. 5. At this time, the first projecting section 16 is outward biased along with the free end 15, permitting the plug 30 to gradually enter the cavity 12 of the socket without being obstructed. Therefore, the plug 30 can be smoothly telecommunicationally connected with the socket 10.

The telecommunication socket 10 of the present invention has simple structure and is able to stop incorrect telecommunication plug 20 from being negligently inserted into the socket 10. Therefore, the modem and the likes are well protected.

The above embodiment is only used to illustrate the present invention, not intended to limit the scope thereof. Many modifications of the above embodiment can be made without departing from the spirit of the present invention.

What is claimed is:

1. A telecommunication socket structure comprising a rigid housing defining an internal cavity, an inner face of the housing being formed with channels for guiding a telecommunication plug to insert into the cavity of the socket and restricting the plug from laterally displacing, said socket structure being characterized by at least one resilient arm disposed in a predetermined position in the cavity near an opening of the cavity, the resilient arm having a free end formed with a stopper section for stopping the plug from entering the socket, whereby the free end can be laterally biased by external force relative to the cavity, permitting the plug to be inserted into the socket, wherein the free end of the resilient arm has a first projecting section and a second projecting section, the first projecting section being positioned in a relatively backward position in the cavity, while the second projecting section being positioned in a relatively forward position in the cavity, the first projecting section being formed with the stopper section facing the opening of the cavity, wherein the first and second projecting sections are adjacent to each other and the surfaces of the first and second projecting sections are inclined in reverse directions to form a connecting ridgeline.

2. The telecommunication socket structure as claimed in claim 1, wherein the resilient arm is positioned in the cavity near lateral side thereof.

3. The telecommunication socket structure as claimed in claim 1, wherein the second projecting section is formed on an outer side of the first projecting section.

4. The telecommunication socket structure as claimed in claim 1, wherein first and second projecting sections have the same height.

* * * * *